US010421919B2

(12) United States Patent
Parkinson

(10) Patent No.: US 10,421,919 B2
(45) Date of Patent: Sep. 24, 2019

(54) GASIFIER

(71) Applicant: Pyrocore S.A., Brussels (BE)

(72) Inventor: David John Parkinson, Clevedon (GB)

(73) Assignee: PYROCORE S.A., Brussels (BE)

( * ) Notice: Subject to any disclaimer, the term of this patent is extended or adjusted under 35 U.S.C. 154(b) by 0 days.

(21) Appl. No.: 15/323,730

(22) PCT Filed: Jul. 2, 2015

(86) PCT No.: PCT/GB2015/051937

§ 371 (c)(1),
(2) Date: Jan. 3, 2017

(87) PCT Pub. No.: WO2016/001676

PCT Pub. Date: Jan. 7, 2016

(65) Prior Publication Data

US 2017/0130149 A1 May 11, 2017

(30) Foreign Application Priority Data

Jul. 3, 2014 (GB) ..... 1411921.8

(51) Int. Cl.
*C10J 3/00* (2006.01)
*C10J 3/30* (2006.01)
(Continued)

(52) U.S. Cl.
CPC ..... *C10J 3/66* (2013.01); *C10J 3/005* (2013.01); *C10J 3/30* (2013.01); *C10J 3/32* (2013.01);
(Continued)

(58) Field of Classification Search
CPC ..... C10J 3/42; C10J 3/40; C10J 3/005; C10B 47/30
See application file for complete search history.

(56) References Cited

U.S. PATENT DOCUMENTS 2,116,774 A 5/1938 Walter
2,147,324 A 2/1939 van Ackeren
(Continued)

FOREIGN PATENT DOCUMENTS

CN 101693842 4/2010
CN 102358852 2/2012
(Continued)

OTHER PUBLICATIONS

"Experts in Waste to Energy," from http://web.archive.org/web/20130325172229/http://www.dps-global.com/assets/files/environmental/0117%20DPS%206pp%20Enviro%20Brochure%20LR.pdf, Aug. 2015, 6 pages.

(Continued)

*Primary Examiner* — Matthew J Merkling
(74) *Attorney, Agent, or Firm* — Epstein Drangel LLP; Robert L. Epstein

(57) ABSTRACT

A gasifier may include a chamber wall defining a gasification chamber configured to allow gasification of feedstock material. The gasifier may also include an ash grate disposed in the gasification chamber. The gasifier may further include a rotary crusher disposed in the gasification chamber above the ash grate. The rotary crusher may include at least one crushing element. The rotary crusher may be configured to break apart, between the at least one crushing element and an opposing surface, the feedstock material responsive to rotation of the rotary crusher.

20 Claims, 5 Drawing Sheets

(51) Int. Cl.

| | |
|---|---|
| ***C10J 3/32*** | (2006.01) |
| ***C10J 3/36*** | (2006.01) |
| ***C10J 3/52*** | (2006.01) |
| ***C10J 3/66*** | (2006.01) |
| ***F23G 5/26*** | (2006.01) |
| ***F23G 5/027*** | (2006.01) |

(52) U.S. Cl.

CPC ..... *C10J 3/36* (2013.01); *C10J 3/526* (2013.01); *F23G 5/0273* (2013.01); *F23G 5/26* (2013.01); *C10J 2200/09* (2013.01); *C10J 2200/152* (2013.01); *C10J 2200/158* (2013.01); *C10J 2300/0946* (2013.01); *F23G 2201/303* (2013.01); *F23G 2201/304* (2013.01); *F23G 2203/20* (2013.01); *F23G 2205/121* (2013.01); *F23G 2206/10* (2013.01)

(56) References Cited

U.S. PATENT DOCUMENTS

| | | | | |
|---|---|---|---|---|
| 2,208,757 | A | 7/1940 | Fitch | |
| 2,286,268 | A | 6/1942 | Fitch | |
| 3,454,382 | A * | 7/1969 | Hamilton | C10J 3/20 201/34 |
| 3,916,807 | A | 11/1975 | Eiki | |
| 4,308,103 | A | 12/1981 | Rotter | |
| 4,530,702 | A | 7/1985 | Fetters et al. | |
| 4,751,887 | A | 6/1988 | Terry et al. | |
| 4,870,911 | A | 10/1989 | Chang et al. | |
| 5,452,492 | A | 9/1995 | Hamilton | |
| 5,662,052 | A | 9/1997 | McIntosh et al. | |
| 6,276,286 | B1 | 8/2001 | Williams et al. | |
| 7,875,090 | B2 * | 1/2011 | Dietenberger | C10J 3/463 202/219 |
| 7,976,259 | B2 | 7/2011 | Craig et al. | |
| 8,574,325 | B2 | 11/2013 | Jensen et al. | |
| 9,605,210 | B2 | 3/2017 | Tucker et al. | |
| 2004/0178053 | A1 | 9/2004 | Burke et al. | |
| 2005/0095183 | A1 * | 5/2005 | Rehmat | C01B 3/382 422/600 |
| 2008/0149471 | A1 | 6/2008 | Wolfe | |
| 2009/0014689 | A1 | 1/2009 | Klepper et al. | |
| 2010/0132258 | A1 | 6/2010 | Linck et al. | |
| 2010/0288618 | A1 | 11/2010 | Feerer et al. | |
| 2012/0066974 | A1 | 3/2012 | Jorgenson et al. | |
| 2012/0205219 | A1 | 8/2012 | Nickerson et al. | |
| 2013/0199918 | A1 | 8/2013 | Jones et al. | |
| 2013/0199919 | A1 * | 8/2013 | Li | C10B 47/30 201/7 |
| 2013/0323614 | A1 | 12/2013 | Chapman et al. | |
| 2015/0041716 | A1 * | 2/2015 | Stadler | F23G 5/26 252/372 |
| 2016/0304345 | A1 * | 10/2016 | Li | C01B 3/56 |

FOREIGN PATENT DOCUMENTS

| | | |
|---|---|---|
| DE | 102005000768 | 4/1998 |
| DE | 19700655 | 7/2006 |
| EP | 138213 | 4/1985 |
| EP | 1217318 | 6/2002 |
| EP | 2014744 | 1/2009 |
| EP | 2522707 | 11/2012 |
| GB | 576504 | 4/1946 |
| GB | 2472989 | 3/2011 |
| GB | 2489959 | 10/2012 |
| GB | 2490346 | 10/2012 |
| GB | 2526087 | 11/2015 |
| GB | 2527830 | 1/2016 |
| GB | 2529053 | 2/2016 |
| IT | 1206670 | 4/1989 |
| JP | H11189773 | 7/1999 |
| JP | 2001141220 | 5/2001 |
| JP | 2002060754 | 2/2002 |
| JP | 2006299010 | 11/2006 |
| JP | 2007056100 | 3/2007 |
| JP | 2013159778 | 8/2013 |
| KR | 20100004627 U | 5/2010 |
| WO | 8302568 | 8/1983 |
| WO | 92002599 | 2/1992 |
| WO | 2001005910 | 1/2001 |
| WO | 2009100841 | 8/2009 |
| WO | 2009138757 | 11/2009 |
| WO | 2010047283 | 4/2010 |
| WO | 2012100247 | 7/2012 |
| WO | 2013110981 | 8/2013 |
| WO | 2013119941 | 8/2013 |
| WO | 2013183003 | 12/2013 |
| WO | 2013191897 | 12/2013 |
| WO | 2016001677 | 1/2016 |
| WO | 2016001678 | 1/2016 |
| WO | 2015173555 | 11/2016 |

OTHER PUBLICATIONS

U.S. Office Action, U.S. Appl. No. 15/323,730, dated Jul. 10, 2018.
U.S. Office Action, U.S. Appl. No. 15/323,731, dated Aug. 1, 2018.
U.S. Office Action, U.S. Appl. No. 15/323,731, dated Feb. 12, 2019.

* cited by examiner

GASIFIER

The present application is a National Stage Application filed under 35 U.S.C. § 371 of International Patent Application Number PCT/GB2015/051937, filed Jul. 2, 2015, which claims priority to Great Britain Patent Application Number 1411921.8, filed Jul. 3, 2014. Those applications are incorporated herein by reference in their entirety and for all purposes.

The invention relates to a gasifier.

BACKGROUND

It is known to process waste by pyrolysis and gasification in modular waste processing apparatus including separate pyrolysis and gasification units. Pyrolysis is the thermal decomposition of material under the action of heat alone (i.e. in the absence of oxygen), and is an endothermic process. During pyrolysis, a pyrolysis feedstock (such as human or consumer waste) is decomposed to form pyrolysis char and combustible pyrolysis gas.

Gasification is the exothermic reaction of carbonaceous material, such as pyrolysis char, with oxygen and/or steam to produce combustible syngas. Syngas may include hydrogen, carbon monoxide and carbon dioxide.

The resulting pyrolysis gas and syngas can be combusted to provide thermal energy to sustain the pyrolysis process, and any remaining thermal energy can be converted (e.g. to electricity using a generator) or used onsite.

However, known waste processing apparatus for separately conducting pyrolysis, gasification and combustion suffer from a number of problems.

In particular, particulate material such as ash is known to cause problems in previously considered waste processing apparatus. The deposition and build-up of particulates in an oxidiser and downstream of the oxidiser in a heating chamber for the pyrolyser can reduce the performance of the waste processing apparatus and can result in frequent maintenance and down-time of the apparatus to remove the particulate material. For example, deposition of particulate material on a pyrolysis tube within the heating chamber can result in inefficient heat transfer between the hot gas in the heating chamber and feedstock material received in the pyrolysis chamber. Further, particulate material is known to build-up to form a bed of settled particulate material on the floor of the oxidiser and the floor of the heating chamber for the pyrolyser, which is typically removed by opening up the oxidiser and heating chamber respectively.

In addition, in previously considered gasifiers a bed of feedstock material such as pyrolysis feedstock in the gasifier may become agglomerated or caked, which may result in an inefficient gasification process and/or a blockage in the bed.

SUMMARY

It is therefore desirable to provide an improved gasifier that may mitigate the above problems.

According to an aspect of the invention there is provided a gasifier for receiving primary combustible gas and feedstock material for gasification to produce secondary combustible gas, the gasifier comprising: a gasification chamber within which a bed of feedstock material is gasified to produce ash and secondary combustible gas; a feedstock inlet opening into the gasification chamber for introducing feedstock material and primary combustible gas into the gasification chamber; a gas outlet opening into the gasification chamber for discharging primary combustible gas received in the gasification chamber and secondary combustible gas generated in the gasification chamber from the gasification chamber; and a flow path between the feedstock inlet and the gas outlet which passes through the gasification chamber so that primary combustible gas flows through the gasification chamber, a portion of the flow path having an upwards component within the gasification chamber so that particulate material entrained in the primary combustible gas separates from the primary combustible gas and falls towards the bed of feedstock material.

The gasification chamber may be arranged to be oriented vertically so as to receive feedstock material in an upper portion of the gasification chamber and to discharge ash from a lower portion of the gasification chamber.

The gasifier may comprise a floor, which may be an ash grate disposed within the gasification chamber. The feedstock inlet and gas outlet may open into the gasification chamber above the floor. The gasification chamber may be arranged to be oriented vertically so as to receive feedstock material above the floor and to discharge ash from below the floor.

The flow path may turn within the gasification chamber from an inlet portion of the flow path having a downwards component to the portion having an upwards component so that particulate material entrained in the primary combustible gas separates from the primary combustible gas and falls towards the bed of feedstock material.

The flow path may be defined to separate the particulate material entrained with the primary combustible gas at least partly by inertial separation. In particular, the particulate material may separate from the primary combustible gas at least partly due to its inertia in a direction other than the direction of the portion of the flow path having an upwards component (e.g. a downwards direction). For example, the primary combustible gas and entrained material may be introduced into the gasification chamber in a generally downward direction and may turn within the gasification chamber to flow along the portion of the flow path having an upwards component. Accordingly, the downward inertia of the particulate material may be too great to turn along the flow path, causing the particulate material to separate from the primary combustible gas. The flow path may be defined to separate the particulate material entrained with the primary combustible gas at least partly by gravity.

The feedstock inlet may be arranged to introduce feedstock material and primary combustible gas into the upper portion of the gasification chamber, which may be a portion of the gasification chamber above a floor. The gas outlet may be arranged to discharge primary combustible gas and secondary combustible gas from an upper portion of the gasification chamber.

The feedstock inlet may be configured to introduce the primary combustible gas into the gasification chamber along an inlet portion of the flow path having a downward component within the gasification chamber (i.e. a portion of the flow path commencing at the feedstock inlet). The gas outlet may be configured so that primary combustible gas flows from the gasification chamber towards the gas outlet along an outlet portion of the flow path having an upward component within the gasification chamber (i.e. a portion of the flow path terminating at the gas outlet).

The feedstock inlet may comprise a duct arranged so that an inlet portion of the flow path within the gasification chamber along which primary combustible gas flows into the gasification chamber has a downward component. The direction of the inlet portion of the flow path may be generally downward. The direction of the inlet portion of the flow path may be substantially vertically downward.

The gas outlet may comprise a duct arranged so that an outlet portion of the flow path within the gasification chamber along which primary combustible gas flows towards the gas outlet has an upward component.

The inlet portion of the flow path may be oriented no less than 20 degrees from the vertical. The outlet portion of the flow path may be oriented no less than 25 degrees from the vertical.

The gasifier may comprise a baffle structure disposed between the feedstock inlet and the gas outlet and configured so that the flow path turns upwardly around the baffle structure within the gasification chamber between the feedstock inlet and the gas outlet. The baffle structure may comprise a portion of a top wall of the gasifier. The baffle structure may project downwardly into the gasification chamber. The baffle structure may comprise a wall of the feedstock inlet and/or a wall of the gas outlet. The baffle structure may comprise a wall of the feedstock inlet and a wall of the gas outlet, which may be spaced apart from one another, for example, by a portion of the top wall of the gasification chamber.

The gas outlet may open into the gasification chamber above the feedstock inlet. Accordingly, the flow path from the feedstock inlet to the gas outlet has a portion having an upward component.

The feedstock inlet may be disposed at a substantially central position with respect to an axis of the gasification chamber, and the gas outlet may be disposed at a radially outer position with respect to the same axis. The axis may be a generally vertical axis of the gasifier corresponding to a transport direction of feedstock material gasified within the gasification chamber. The transport direction corresponds to the direction in which the feedstock material moves through the gasification chamber as it is gasified. For example, when feedstock material is received in an upper portion of the gasification chamber (i.e. above a floor within the gasification chamber) and is discharged as ash from a lower portion of the gasification chamber (i.e. below a floor within the gasification chamber), the transport direction is generally downward.

The gas outlet may have an opening into the gasification chamber in the form of an annulus. Alternatively, the opening into the gasification chamber may be in the form of a sector of an annulus. The sector may be a major sector (i.e. extending over an arc of more than 180°). The annulus may be coaxial with the feedstock inlet.

The primary combustible gas may be pyrolysis gas from an upstream pyrolysis process. The secondary combustible gas may be syngas generated by the gasification of the feedstock material.

The baffle structure may comprise an annular structure disposed between the feedstock inlet and the gas outlet that defines a wall of the feedstock inlet and/or a wall of the gas outlet.

References to a wall of the feedstock inlet and/or a wall of the gas outlet herein relate to the internal surface of the inlet along which gas can flow.

There is also provided waste processing apparatus comprising: a pyrolyser for decomposing pyrolysis feedstock material to produce pyrolysis char and pyrolysis gas; and a gasifier in accordance with any statement herein, wherein pyrolysis char forms the feedstock material for the gasifier, and wherein the pyrolysis gas forms the primary combustible gas.

According to a further aspect of the invention there is provided a gasifier for receiving feedstock material, the gasifier comprising: a chamber wall defining a gasification chamber for gasification of a bed of feedstock material; an ash grate disposed in the gasification chamber; and a rotary crusher disposed in the gasification chamber above the ash grate and provided with at least one crushing element; wherein in use rotation of the crusher causes agglomerated feedstock material in the bed to break apart between the crushing element and an opposing surface.

There may be a plurality of crushing elements. The or each crushing element may comprise a crushing projection extending from a crusher base. The crushing projections may comprise a spherical cap. The or each crushing projection may extend over at least 5%, at least 10%, at least 20%, at least 30%, at least 40% or at least 50% of the distance between the crusher base and the opposing surface.

The rotary crusher may comprise a crusher base which supports the or each crushing element, and the crusher base may be generally dome-shaped.

The ash grate may be fixed in the gasification chamber. In other words, the ash grate may be statically mounted. The ash grate may be replaceable.

The opposing surface may be the chamber wall. In other words, the opposing surface may be an inner surface of the chamber wall or may be defined by the chamber wall. The opposing surface may be a lower portion of the inner surface of the chamber wall.

A portion of the chamber wall against which agglomerated feedstock material is crushed may be replaceable. The replaceable wall section may be received in a cavity. The replaceable wall section may be received in a cavity of the chamber wall.

The replaceable wall section may be composed of a different material to the rest of the chamber wall. The replaceable wall section may be composed of a different material to a fixed or non-replaceable section of the chamber wall. The term replaceable is used herein to refer to a portion of the wall which is designed to be replaced on a frequent or routine basis, as opposed to repairable sections of the wall.

The replaceable wall section may be composed of firebrick. The chamber wall, except the replaceable wall section, may be composed of a suitable refractory lining, such as a high alumina cast, ram-moulded or sprayed refractory or alternatively a cemented firebrick construction.

The gasifier may comprise a wall retainer arranged to retain the replaceable wall section in place. The wall retainer may be replaceable. The wall retainer may comprise an attachment portion for attaching to a corresponding attachment portion within the gasification chamber. The wall retainer may be configured to attach to the chamber wall and/or the ash grate. The wall retainer may be configured to abut the inner surface of the replaceable wall section to retain the replaceable wall section.

Alternatively, the opposing surface may be an inner surface of a crushing wall disposed within the gasification chamber and separated from the chamber wall.

The rotary crusher may comprises gas nozzles for introducing gasification gas into the gasification chamber. The gasification gas may comprise steam or an oxygen-containing gas.

The gas nozzles of the rotary crusher may be the only gas inlets for introducing gasification gas into the gasification chamber. The gas nozzles may extend from a base of the rotary crusher into the gasification chamber so that in use the gas nozzles introduce gasification gas into the gasification chamber at a location separated from the base of the rotary crusher. The gas nozzles may extend from a base of the rotary crusher upwardly into the gasification chamber so that in use the nozzles introduce gasification gas into a substantially central portion of the bed of feedstock material.

The gas nozzles may be coupled to a source of gasification gas by a rotatable shaft to which the rotary crusher is mounted. The rotatable shaft may extend between a motor or drive unit outside of the chamber wall and the rotary crusher through a lower end wall of the chamber wall.

The rotary crusher may be configured to move axially up and down within the gasification chamber as it rotates. The rotary crusher may be mounted on a rotatable shaft of a drive, and the rotatable shaft may be configured to move axially by a camming mechanism, which may be a camming mechanism of the drive.

The rotatable shaft may comprise a primary shaft spline-fitted or keyed with a secondary shaft of the drive for axial movement relative to the secondary shaft. The primary shaft and secondary shaft may rotate together. In use, the secondary shaft may be driven to rotate, thereby causing the primary shaft to rotate by virtue of the spline-fitted or keyed arrangement with the secondary shaft.

The rotary crusher may be mounted on a rotatable shaft of a drive, and the rotatable shaft may be coupled to an actuation mechanism for selectively moving the rotatable shaft and the rotary crusher axially with respect to the gasification chamber.

There is also provided a gasifier in accordance with any statement herein, and waste processing apparatus comprising a gasifier in accordance with any statement herein.

The waste processing apparatus may further comprise a feed assembly for feeding waste into a pyrolyser, a pyrolyser for pyrolysing the waste to form pyrolysis char and pyrolysis gas, and a gasifier in accordance with any statement herein. The waste processing apparatus may further comprise an oxidiser for combusting the pyrolysis gas and syngas generated from the gasification of the pyrolysis char to produce hot gas, and the pyrolyser may comprise a heating vessel arranged to receive the hot gas for heating a pyrolysis tube of the pyrolyser.

Throughout the description and claims of this specification, the words "comprise" and "contain" and variations of the words, for example "comprising" and "comprises", mean "including but not limited to", and do not exclude other components, integers or steps. Moreover the singular encompasses the plural unless the context otherwise requires: in particular, where the indefinite article is used, the specification is to be understood as contemplating plurality as well as singularity, unless the context requires otherwise.

Preferred features of each aspect of the invention may be as described in connection with any of the other aspects. Other features of the invention will become apparent from the following examples. Generally speaking the invention extends to any novel one, or any novel combination, of the features disclosed in this specification (including any accompanying claims and drawings). Thus features, integers or characteristics described in conjunction with a particular aspect, embodiment or example of the invention are to be understood to be applicable to any other aspect, embodiment or example described herein unless incompatible therewith. Moreover unless stated otherwise, any feature disclosed herein may be replaced by an alternative feature serving the same or a similar purpose.

Where upper and lower limits are quoted for a property, then a range of values defined by a combination of any of the upper limits with any of the lower limits may also be implied.

BRIEF DESCRIPTION OF THE DRAWINGS

The invention will now be described by reference to the following drawings, in which.

DETAILED DESCRIPTION

Figure 1:
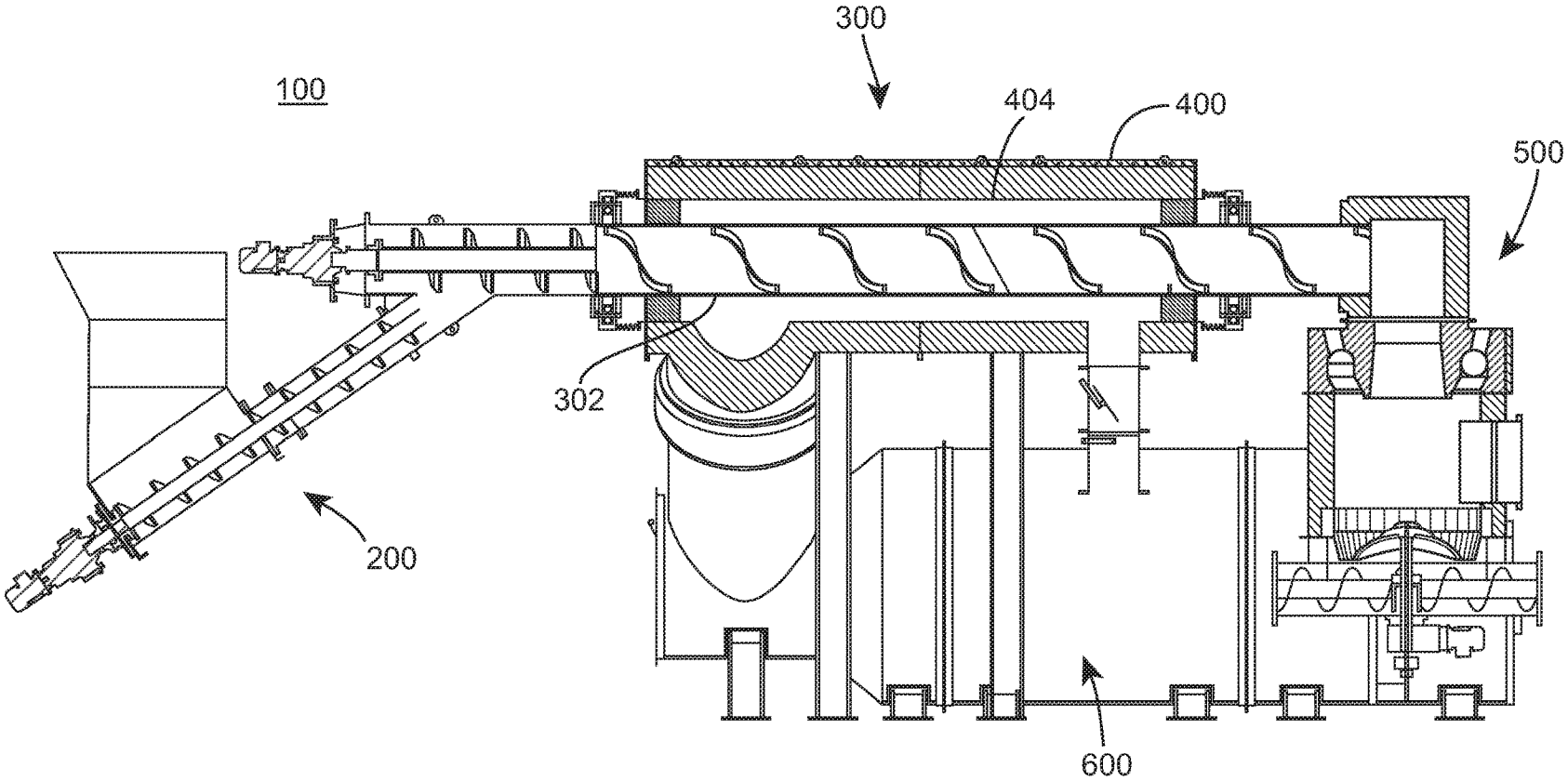
FIG. 1 schematically shows waste processing apparatus according to an embodiment of the invention.

FIG. 1 shows waste processing apparatus 100 comprising a feed assembly 200, a pyrolyser 300 including a rotary kiln or rotary pyrolysis tube 302 and a heating vessel 400, a gasifier 500 and an oxidiser 600.

In use, waste is received in the feed assembly 200 and conveyed into the rotary pyrolysis tube 302 of the pyrolyser 300 where it is decomposed under the action of heat to form pyrolysis char and pyrolysis gas. The rotary pyrolysis tube 302 is disposed within the heating chamber 404 of the heating vessel 400, and heat is transferred to the rotary pyrolysis tube 302 from hot gases received within the heating chamber 404. The pyrolysis char and pyrolysis gas exit the rotary pyrolysis tube 302 to enter the gasifier 500, where the pyrolysis char is gasified by the introduction of oxygen and/or steam to produce syngas and ash. The pyrolysis gas and syngas flow together from the gasifier 500 to the oxidiser 600 (see FIG. 2), where the gas is combusted to produce hot gas. The hot gas is redirected to the heating chamber 404 of the heating vessel 400 to heat the rotary pyrolysis tube 302. The hot gas is then directed from the heating chamber 404 to a separate heat recovery unit, such as a steam turbine for power generation.

Ash formed in the gasifier and collected in the oxidiser and heating chamber is collected in an ash bin (not shown) of an ash collection unit by a number of ash feed ducts 702, 704.

Figure 3:
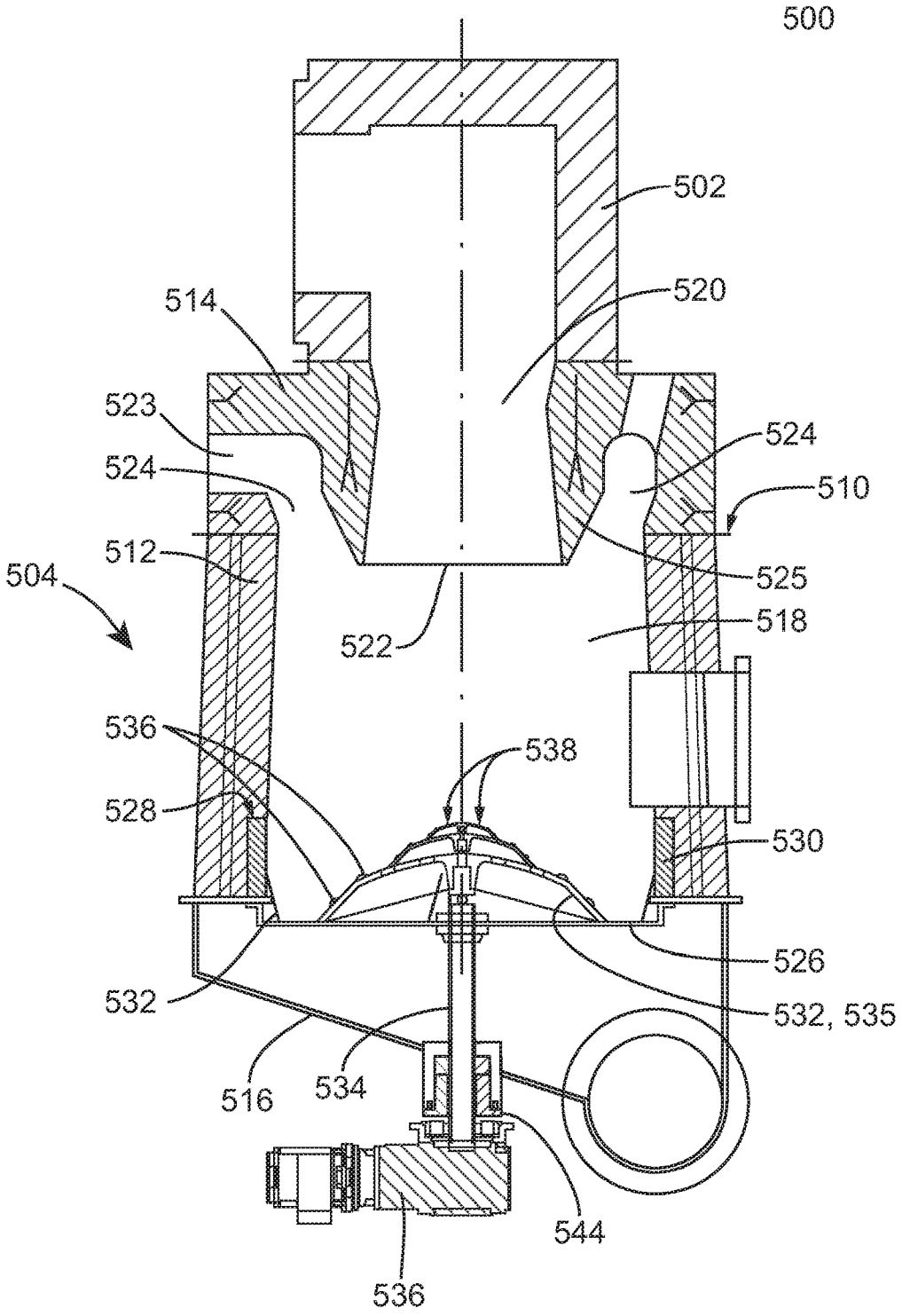
FIG. 3 shows a gasifier for the waste processing apparatus of FIG. 1

As shown in FIG. 3, the gasifier 500 comprises an interface conduit 502 and a gasification vessel 504. The interface conduit 502 is arranged to receive pyrolysis char and pyrolysis gas from the outlet end of the substantially horizontal pyrolysis tube 302 of the pyrolyser, and to provide the pyrolysis char and pyrolysis gas to the vertically-oriented gasification vessel 504. The interface conduit 502 is coupled to the pyrolysis tube 302 by an outlet rotary seal so that both are sealed from the external atmosphere.

The gasification vessel 504 comprises a refractory-lined chamber wall 510 having an upwardly tapering frustoconical wall portion 512, a top wall portion 514 and a base wall 516 defining between them a gasification chamber 518. The top wall portion 514 has a central conical inlet duct 520 aligned with the central vertical axis A of the gasification chamber 518 and arranged to introduce pyrolysis char and pyrolysis gas into the gasification chamber 518 in a generally downward direction through an inlet opening 522.

Figure 2:
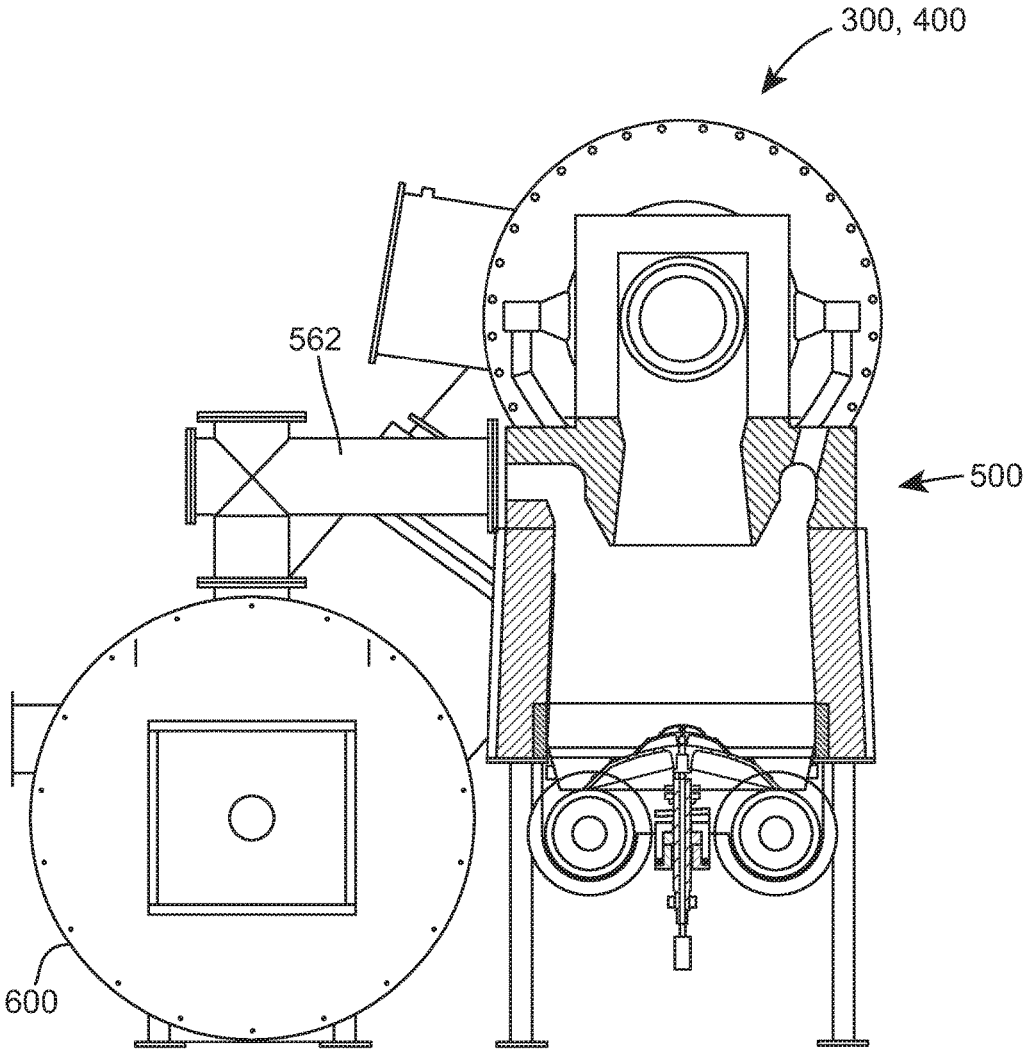
FIG. 2 schematically shows a further view of the waste processing apparatus of FIG. 1.

The top wall portion 514 further comprises a gas outlet duct 523, opening into the gasification chamber 518 at an annular outlet opening 524, for discharging pyrolysis gas received in the gasification chamber 518 and syngas from the gasification chamber 518. The gas outlet 523 is in communication with an oxidiser inlet of the oxidiser 600 via a gas exhaust pipe 562 (FIG. 2).

The conical inlet 520 projects into the centre of the chamber 518 so that the annular outlet opening 524 is above the level of the inlet opening 522.

The top wall portion 514 of the chamber wall 510 forms a baffle structure 525 between the inlet duct 520 and the gas outlet duct 523, around which pyrolysis gas entering the gasification chamber 518 from the inlet duct 520 must flow to be discharged from the gas outlet 523. In this embodiment, the baffle structure 525 partly forms the inner walls of both the inlet duct 520 and the gas outlet duct 523, and is in the form of an annular projection projecting downwardly into the gasification chamber 518.

The gasifier 500 has a flow path between the inlet duct 520 and the gas outlet 523 that extends through the gasification chamber 518. The flow path has an inlet portion which extends downwardly from the inlet opening 522 and turns upwardly within the gasification chamber to an outlet portion which extends upwardly towards the annular outlet opening 524 and the gas outlet duct 523. In this embodiment, the flow path is constrained to turn upwardly around the baffle structure 525.

An ash grate 526 is disposed within the gasification chamber 518 above the level of the base wall 516 and is mounted to the frustoconical wall portion 512.

The frustoconical wall portion 512 has an annular recess 528 at its lower end above the ash grate 526 in which a replaceable wall section 530 composed of firebrick is received. The replaceable wall section 530 is retained in place by a replaceable annular wall retainer 532 that is releasably coupled to the ash grate 526 and abuts the radially inner surface of the replaceable wall section 530 to hold it in place.

The gasifier 504 further comprises a rotary crusher 532 mounted on a shaft 534 extending through the base wall 516 and ash grate 526 of the gasifier 504 and coupled to an external drive unit 536. The shaft extends through a seal 544 received in an opening in the base wall 516. The rotary crusher 532 is disposed immediately above the ash grate 526 and has a generally dome-shaped base 535 to which a plurality of crushing elements or projections 536 are mounted. The crushing projections 536 protrude from the rotary crusher base 535 towards the replaceable wall section 530 and have a spherical cap.

The rotary crusher 532 further comprises a plurality of nozzles 538 mounted on the base 535 and coupled to an external source of gasification gas (i.e. oxygen and/or steam) for introducing gasification gas into a bed of pyrolysis char (i.e. feedstock material for the gasifier 500) within the gasification chamber 518. Gas conduits (not shown) for the nozzles extend through the rotatable shaft 534 to which the rotary crusher 532 is mounted. In this embodiment, the nozzles 538 are directly mounted on the base 535, although it will be appreciated that in other embodiments the nozzles may be provided at the end of extension supports extending from the base 535 of the rotary crusher into the gasification chamber 518 so that, in use, gasification gas is introduced towards the centre of the bed of pyrolysis char.

Figure 5:
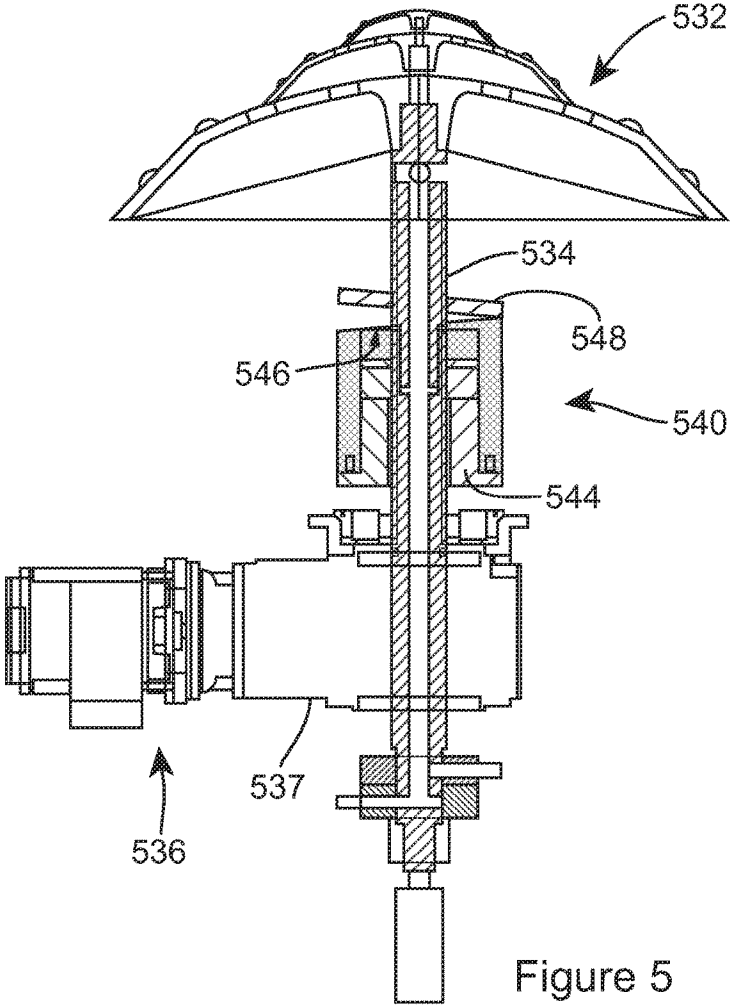
FIG. 5 shows the camming mechanism of FIG. 4 rotated through 180°.
Figure 4:
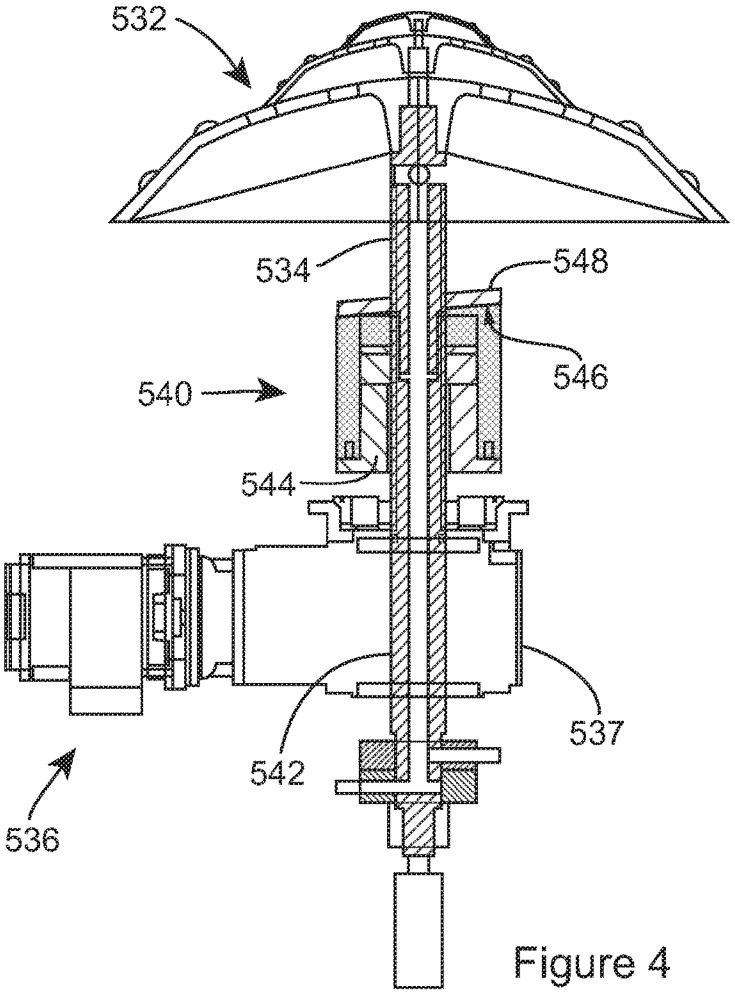
FIG. 4 shows the camming mechanism of the rotary crusher of the gasifier of FIG. 3.

As shown in FIGS. 4 and 5, the shaft 534 for the rotary crusher 532 is keyed with a stub shaft 542 of the drive unit 536, and is configured to move axially with respect to the stub shaft 542 by way of a swash plate mechanism 540.

The stub shaft 542 extends vertically upwardly from below a hollow gear box 537 of the drive unit 536 through the gear box 537 and towards the rotary crusher 532, and is driven to rotate by the hollow gear box 537. The shaft 534 for the rotary crusher 532 is keyed with the stub shaft 542 so that it is constrained to rotate axially with the stub shaft 542 but is axially movable relative to the stub shaft 542. A seal 544 for the shaft 534, which is received in a shaft opening in the base wall 516 of the chamber wall 510, supports a cam plate 546 having a top surface inclined with respect to the horizontal. A corresponding inclined swash plate 548 is mounted to the shaft 534 for the rotary crusher 532 so that it is constrained to rotate with the shaft 534 and is supported by the cam plate 546. Accordingly, as the stub shaft 542 rotates, the shaft 534 rotates and moves axially up and down as the swash plate 548 rides over the cam plate 546. FIG. 4 shows a lower position of the rotary crusher 532 corresponding to alignment between the swash plate 548 and cam plate 546, whereas FIG. 5 shows an upper position of the rotary crusher 532 corresponding to rotation of the shaft 534 by 180°.

The lower end of the stub shaft 542 below the hollow gear box 537 is provided with inlets 543 for receiving gasification gas for injecting into the gasifier chamber 518. The stub shaft 542 is hollow and is in fluid communication with the hollow interior of the shaft 534 for the rotary crusher so that, in use, gasification gas flows through the stub shaft 542, the shaft 534, and the base 535 and nozzle 538 of the rotary crusher 532 into the gasification chamber 518.

Figure 6:
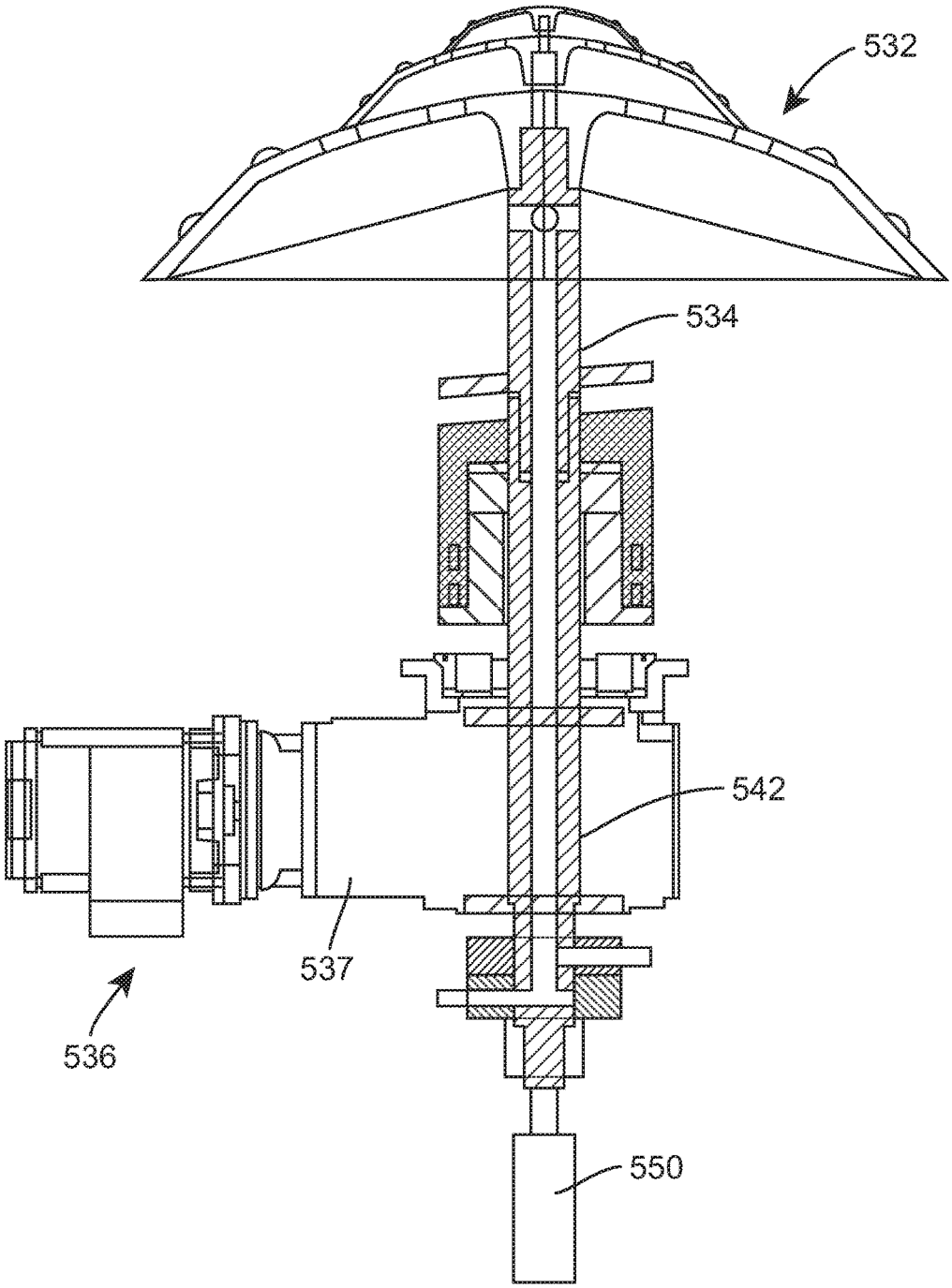
FIG. 6 shows the jacking mechanism of the rotary crusher of the gasifier of FIG. 3.

As shown in FIG. 6, the drive unit 536 further comprises a jack 550 for selectively moving the stub shaft 542 and the shaft 534 for the rotary crusher vertically up and down in a jacking operation, independently of the swash plate mechanism 540. The jack 550 may be any suitable actuator, such as a hydraulic actuator. The drive unit 536 has a controller for selectively initiating a jacking operation based on a fixed schedule, a detected blockage in the bed of the gasifier, or on demand. The stub shaft 534 is configured to move vertically relative to the hollow gear box 537 of the drive unit 536, so that the gear box 537 remains stationary during a jacking operation.

In use, pyrolysis char from the rotary pyrolysis tube 302 of the pyrolyser 300 is conveyed into the interface conduit 502 of the gasifier 500, and falls downwardly into the gasification chamber 518 through the downwardly extending inlet duct 520 to form a bed of pyrolysis char for gasification. At the same time, pyrolysis gas flows through the interface conduit 502 from the pyrolysis tube 302 and downwardly through the inlet duct 520 into the gasification chamber 518.

Some particulate material, such as ash, may be entrained with the pyrolysis gas entering the gasification chamber 518. The pyrolysis gas flows along the flow path within the gasification chamber described above between the inlet opening 522 of the inlet duct 520 and the annular outlet opening 524 of the gas outlet 523. Accordingly, the pyrolysis gas initially flows downwardly along an inlet portion of the flow path, and then turns upwardly within the gasification chamber 518 around the baffle structure 525. Whilst the light pyrolysis gas can turn upwardly to be drawn out of the gas outlet duct 523, the heavier particulate material entrained in the gas has too much downward momentum to turn upwardly within the gasification chamber, and therefore separates from the pyrolysis gas and falls towards the bed of pyrolysis char. In addition, the particulate material may be drawn downwardly by gravity.

Gasification gas (i.e. oxygen and/or steam) is introduced into the bed of pyrolysis char through the nozzles 538 on the rotary crusher to fuel the gasification reaction, and the pyrolysis char is gasified to form syngas and ash. The syngas moves upwardly through the bed towards the annular outlet opening 524 and is discharged from the gasification chamber 518 via the gas outlet 523, together with the pyrolysis gas, for combustion in the oxidiser 600.

The rotary crusher 532 is driven to rotate by the drive unit 536 during the gasification reaction. The crushing projections 532 agitate the pyrolysis char and crush agglomerated pyrolysis char against the replaceable wall section 530 to break it apart. The rotary crusher 532 is driven to rotate at a speed of five revolutions per minute (0.52 radians per second). Breaking apart the pyrolysis char increases the surface area of the pyrolysis char and therefore increases the efficiency of the gasification reaction. In addition, breaking apart the pyrolysis char can prevent blockages from forming in the bed due to the agglomeration of pyrolysis char, which could otherwise result in the gasifier (and the associated waste processing unit) being taken out of service.

The rotary crusher 532 moves axially up and down once per revolution as the swash plate 548 rides over the cam plate 546. The axial movement of the rotary crusher 532 agitates the bed of pyrolysis char during gasification to break it apart. The drive unit controller selectively initiates a jacking operation in which the jack 500 drives the stub shaft 542, and thereby the shaft 534 and rotary crusher 532 axially up and down to agitate the bed of pyrolysis char. In this embodiment, the drive unit controller is configured to initiate a jacking operation on a fixed schedule, such as of once every five minutes. In addition, a jacking operation can be manually initiated, for example by a push button command, or a signal from a remote operating station, to the drive unit controller. For instance, an operator may selectively initiate a jacking operation when it is determined that there may be a blockage in the bed, for example when ash is discharged at an unusually low discharge rate. In other embodiments, the gasifier may be configured so that a jacking operation is initiated whenever a blockage in the bed or a bridged condition is detected. A blockage in the bed may be detected by monitoring the resistance to rotation of the rotary crusher (e.g. with a torque sensor or by monitoring the power consumption of the rotary crusher), or by monitoring an ash output rate of the gasifier. A bridged condition occurs when the bed becomes compacted at an intermediate level in the gasification chamber (i.e. above the rotary crusher 532), so as to form a cavity within the gasification chamber. The bridge condition is therefore a specific type of blockage. The bridged condition may be detected by monitoring an ash output rate of the gasifier. For example, the ash output rate may be significantly reduced when there is a bridge, whilst the rotary crusher may not experience significant resistance to rotation. The frustoconical wall 512 of the gasification chamber 518 also helps to prevent a bridged condition as the frustoconical wall 512 tends to divert material downwardly as it is radially outwardly compacted.

The swash plate mechanism 540 and the jack 500 therefore provide means of agitating the bed of pyrolysis char during gasification to break apart pyrolysis char and prevent blockage.

The replaceable wall section may experience increased wear relative the rest of the chamber wall 510 owing to the crushing action of the rotary crusher 532. During scheduled maintenance in which the gasifier is taken out of service, the replaceable wall section 530 is replaced by removing the wall retainer 532 and withdrawing the replaceable wall section 530 from the cavity 528. A replacement wall section 530 is then inserted into the cavity 528, and the wall retainer 532 is re-inserted to retain it in place.

The provision of the cavity in the chamber wall, the replaceable wall section and the wall retainer therefore allow the portion of the wall that experiences the highest wear to be easily replaced.

The invention claimed is:

1. A gasifier comprising:

a chamber wall defining a gasification chamber configured to allow gasification of feedstock material;

an ash grate disposed in said gasification chamber;

a rotary crusher disposed in said gasification chamber above said ash grate;

a rotatable shaft coupled with said rotary crusher; and a camming mechanism configured to move said rotatable shaft and said rotary crusher axially with respect to said gasification chamber, and wherein said rotary crusher includes at least one crushing element, wherein said rotary crusher is configured to break apart, between said at least one crushing element and an opposing surface, said feedstock material responsive to rotation of said rotary crusher, and wherein said rotary crusher is configured to contemporaneously rotate and move axially within said gasification chamber.

2. The gasifier of claim 1, wherein said rotary crusher comprises a crusher base configured to support said at least one crushing element, and wherein said crusher base is dome-shaped.

3. The gasifier of claim 1, wherein said ash grate is fixed in said gasification chamber.

4. The gasifier of claim 1, wherein said opposing surface is a surface of a portion of said chamber wall.

5. The gasifier of claim 1, wherein said chamber wall defines a cavity, and further comprising:

an element disposed at least partially within said cavity, and wherein said opposing surface is a surface of said element.

6. The gasifier of claim 5, wherein said element is replaceable.

7. The gasifier of claim 5, wherein said element is composed of a different material than said chamber wall.

8. The gasifier of claim 5, wherein said element is composed of firebrick.

9. The gasifier of claim 5 further comprising:

a wall retainer arranged to retain said element in place.

10. The gasifier of claim 1, wherein said rotary crusher includes at least one gas nozzle configured to introduce gasification gas into said gasification chamber.

11. The gasifier of claim 10 further comprising:

a rotatable shaft coupled with said rotary crusher, and wherein said rotatable shaft is configured to provide fluid communication between said at least one gas nozzle and a source of said gasification gas.

12. The gasifier of claim 1 further comprising:

a drive assembly coupled with said rotatable shaft, wherein said drive assembly includes a drive unit and a gearbox, and wherein said drive assembly is configured to rotate said rotatable shaft.

13. The gasifier of claim 1 further comprising:

an actuation mechanism coupled with said rotatable shaft, wherein said actuation mechanism is configured to move said rotatable shaft and said rotary crusher axially with respect to said gasification chamber.

14. The gasifier of claim 13, wherein said actuation mechanism is configured to move said rotatable shaft and said rotary crusher independently of said camming mechanism.

15. A waste processing apparatus comprising:

a pyrolyser configured to decompose waste to produce feedstock material; and a gasifier comprising:

a chamber wall defining a gasification chamber configured to allow gasification of said feedstock material;

an ash grate disposed in said gasification chamber;

a rotary crusher disposed in said gasification chamber above said ash grate;

a rotatable shaft coupled with said rotary crusher; and a camming mechanism configured to move said rotatable shaft and said rotary crusher axially with respect to said gasification chamber, and wherein said rotary crusher includes at least one crushing element, wherein said rotary crusher is configured to break apart, between said at least one crushing element and an opposing surface, said feedstock material responsive to rotation of said rotary crusher, and wherein said rotary crusher is configured to contemporaneously rotate and move axially within said gasification chamber.

16. The waste processing apparatus of claim 15, wherein said feedstock material comprises pyrolysis char, and wherein said pyrolyser is configured to produce pyrolysis gas.

17. The waste processing apparatus of claim 15, wherein said pyrolyser includes:

a heating vessel defining a heating chamber; and a rotary pyrolysis tube disposed at least partially within said heating chamber of said heating vessel, wherein said rotary pyrolysis tube is configured to heat said waste to produce said feedstock material.

18. The waste processing apparatus of claim 17, wherein said rotary pyrolysis tube is configured to convey said feedstock material to said gasifier.

19. The waste processing apparatus of claim 17 further comprising:

a feed assembly configured to receive and convey said waste to said rotary pyrolysis tube.

20. The waste processing apparatus of claim 15, wherein said gasifier is configured to produce syngas, and further comprising:

an oxidiser in fluid communication with said gasifier, wherein said oxidiser is configured to receive, from said gasifier, said syngas and pyrolysis gas.

* * * * *